US007965956B2

(12) United States Patent
Lee et al.

(10) Patent No.: US 7,965,956 B2
(45) Date of Patent: Jun. 21, 2011

(54) IMAGE FORMING APPARATUS PREVENTING POWER SUPPLY DURING INITIALIZATION AND CONTROL METHOD THEREOF

(75) Inventors: Nyun-kang Lee, Seoul (KR); Soo-young Jung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 153 days.

(21) Appl. No.: 12/164,220

(22) Filed: Jun. 30, 2008

(65) Prior Publication Data

US 2009/0060551 A1 Mar. 5, 2009

(30) Foreign Application Priority Data

Sep. 3, 2007 (KR) ..... 10-2007-0088823

(51) Int. Cl.
*G03G 15/20* (2006.01)
*G03G 15/00* (2006.01)

(52) U.S. Cl. ..... 399/70; 399/88

(58) Field of Classification Search ..... 399/67, 399/69, 70, 88
See application file for complete search history.

(56) References Cited

U.S. PATENT DOCUMENTS 5,758,228 A * 5/1998 Hirose et al. ..... 399/70
7,113,719 B2 * 9/2006 Kubota ..... 399/70

* cited by examiner

*Primary Examiner* — Hoang Ngo
(74) *Attorney, Agent, or Firm* — Staas & Halsey LLP

(57) ABSTRACT

An image forming apparatus is provided with: a fusing unit which fuses an image transferred to a printing medium; a power supply which supplies power to the fusing unit; a switching unit which switches the power supplied to the fusing unit; and a controller which controls the switching unit to prevent the power from being supplied to the fusing unit in at least a section during initialization of the image forming apparatus.

15 Claims, 6 Drawing Sheets

IMAGE FORMING APPARATUS PREVENTING POWER SUPPLY DURING INITIALIZATION AND CONTROL METHOD THEREOF

CROSS-REFERENCE TO RELATED APPLICATIONS

This application claims all benefits accruing under 35 U.S.C. §119 from Korean Patent Application No. 2007-88823, filed on Sep. 3, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus which controls power supplied to a fusing unit, and a control method thereof.

2. Description of the Related Art

In general, an image forming apparatus, such as a printer, a photo-copier, a facsimile machine and a multi-functional product, forms an image on the basis of printing data. As shown in FIG. 1, a typical image forming apparatus 100 includes, among other features, an image forming unit 110 to form a toner image on a printable medium, and a fusing unit 120 to fuse (fix) the toner image formed on the printable medium.

The image forming unit 110 includes a photosensitive body 111, a charging unit 112 which charges the photosensitive body 111 at a predetermined electric potential, a light exposing unit 113 which scans a light beam corresponding to printing data to the photosensitive body 111 to form an electrostatic latent image, a developing unit 114 which applies a developer (toner) to the electrostatic latent image which is formed on the photosensitive body 111, and a transferring unit 115 which transfers the developer (toner) on the charged photosensitive body 111 to a printable medium.

The image transferred to the printable medium is thermally pressed by the fusing unit 120 and discharged to an outside. The fusing unit 120 is heated at about 200□ by electric power and fuses the image to the printable medium.

In addition, the image forming apparatus 100 is provided with a temperature sensing unit to sense a temperature of the fusing unit 120 and controls power supplied to the fusing unit 120 according to the temperature sensed by the temperature sensing unit, so as to prevent the fusing unit 120 from being overheated.

The image forming apparatus 100 continuously supplies power to the fusing unit 120 until initialization of the image forming apparatus 100 for executing firmware in a processor, i.e., CPU is completed so as to prevent an FPOT (First Print Output Time) from being lengthened during the initialization.

However, the CPU can not operate normally in the FPOT during the initialization. As a result, power being supplied to the fusing unit 120 cannot be controlled by the temperature sensing unit. Accordingly, the power is concentrated on the fusing unit 120, which may affect other electronic devices.

For example, if the image forming apparatus 100 is used with an illuminating lamp, such as an incandescent lamp in a space where a home-use power of 15 A is applied, flicker may occur during the initialization of the image forming apparatus 100 to cause a user's inconvenience.

SUMMARY OF THE INVENTION

Several aspects and example embodiments of the present invention provide an image forming apparatus which can control power being supplied to a fusing unit during initialization of the image forming apparatus, and a control method thereof.

Additional aspects and/or advantages of the invention will be set forth in part in the description which follows and, in part, will be obvious from the description, or may be learned by practice of the present invention.

In accordance with an example embodiment of the present invention, an image forming apparatus is provided with a fusing unit which fuses an image transferred to a printable medium; a power supply which supplies power to the fusing unit; a switching unit which switches the power supplied to the fusing unit; and a controller which controls the switching unit to prevent the power from being supplied to the fusing unit in at least a time section during initialization of the image forming apparatus.

According to an aspect of the present invention, the controller may include a zero-cross detection circuit which detects a zero-cross point of the power supplied from the power supply.

According to another aspect of the present invention, the controller may cut off the power being supplied to the fusing unit at the zero-cross point.

According to an aspect of the present invention, the image forming apparatus may further include a counting circuit which counts the number of pulses of a zero-cross signal which is outputted from the zero-cross detection circuit during the initialization of the image forming apparatus.

According to an aspect of the present invention, the image forming apparatus may further include an AND gate provided to logically combine outputs of the zero-cross detection circuit and the counting circuit.

According to another aspect of the present invention, the image forming apparatus may further include: a temperature sensing unit which senses temperature of the fusing unit; and a CPU which controls the power supplied to the fusing unit on the basis of the temperature sensed by the temperature sensing unit if the initialization of the image forming apparatus is completed.

In accordance with another example embodiment of the present invention, a method of controlling an image forming apparatus including a fusing unit which fuses an image transferred to a printable medium, and a power supply which supplies power to the fusing unit. The method includes: performing initialization to the image forming apparatus when power is supplied thereto; and controlling the power supplied to the fusing unit such that the power is not supplied to the fusing unit in at least a time section during the initialization of the image forming apparatus.

According to an aspect of the present invention, the method may further including detecting a zero-cross point of the power supplied from the power supply.

According to an aspect of the present invention, the power may not be supplied to the fusing unit at the zero-cross point of the power supplied from the power supply.

According to an aspect of the present invention, the method may further include counting the number of pulses of a zero-cross signal which is outputted at the zero-cross point while the power is being supplied to the fusing unit.

According to another aspect of the present invention, the method may further include: sensing temperature of the fusing unit; and controlling the power which is supplied to the fusing unit according to the sensed temperature if the initialization of the image forming apparatus is completed.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
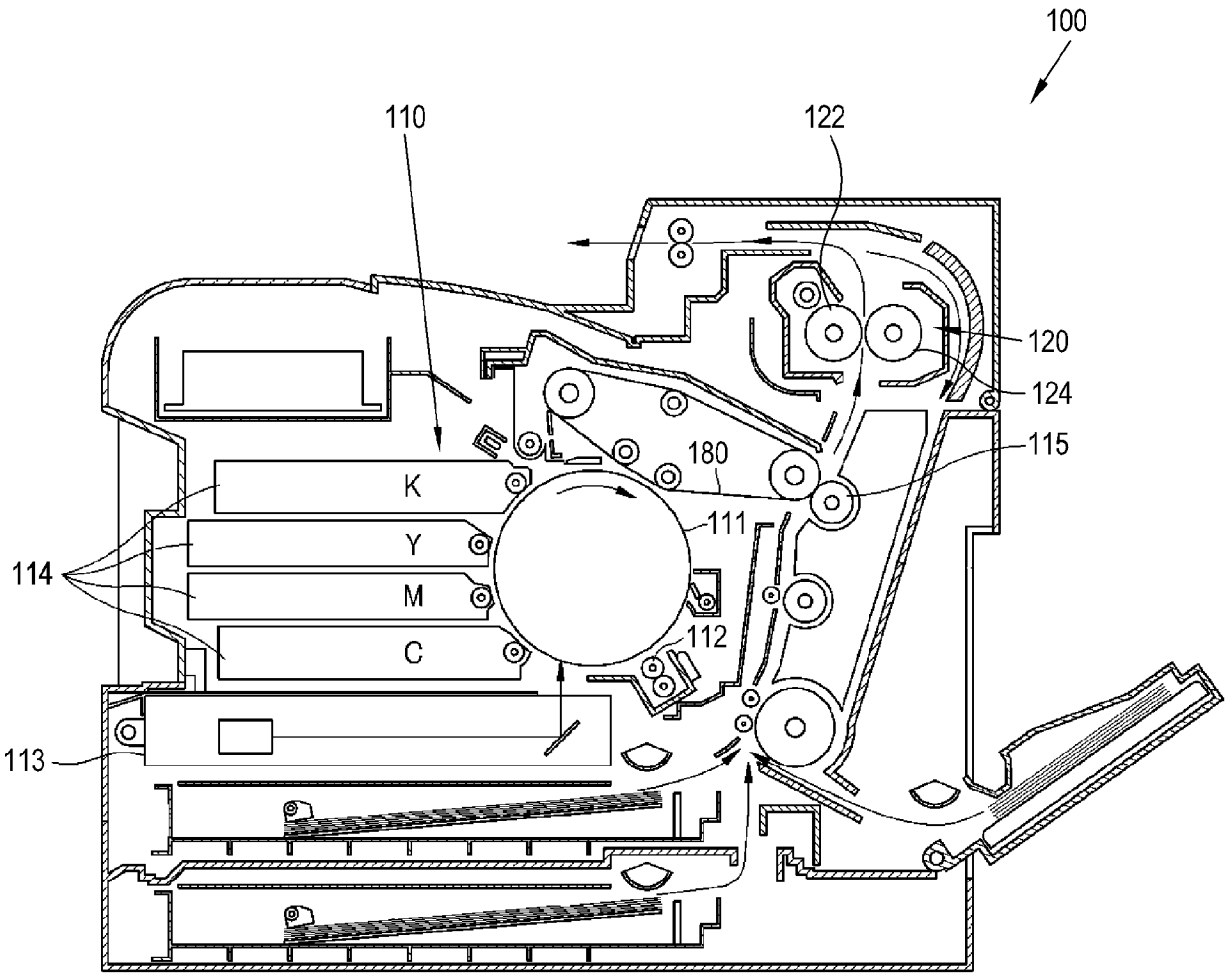
FIG. 1 illustrates a typical image forming apparatus.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
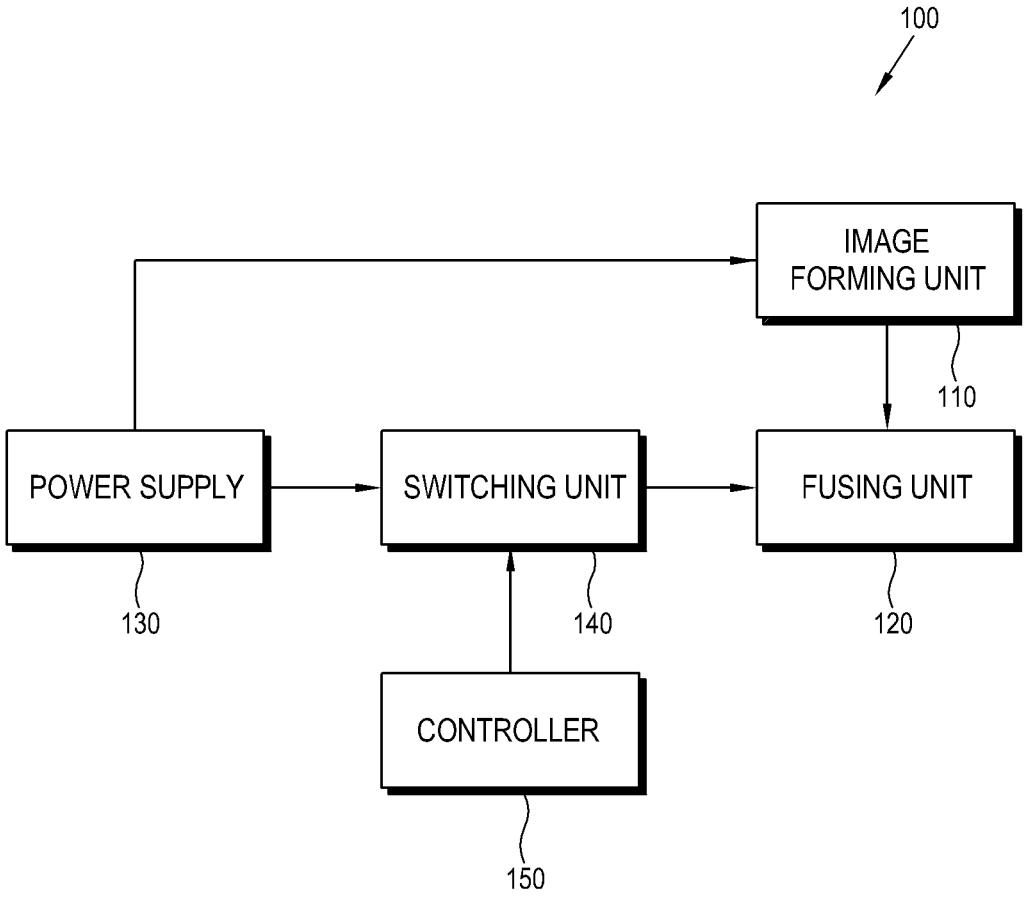
FIG. 2 illustrates an image forming apparatus according to an example embodiment of the present invention.

As shown in FIG. 2, an image forming apparatus 100 according to an example embodiment of the present invention includes an image forming unit 110, a fusing unit 120, a power supply 130, a switching unit 140 and a controller 150. As previously discussed, the image forming apparatus 100 may be provided as an electro-photographic printer, a photocopier, a facsimile machine or a multi-functional product.

The image forming unit 110 forms an image based on printing data. Referring to FIG. 1, the image forming unit 110 includes a photosensitive body 111, a charging unit 112, a light exposing unit 113, a developing unit 114 and a transferring unit 115.

On the photosensitive body 111 is formed an electrostatic latent image based on the printing data. The charging unit 112 charges the photosensitive body 111 at a predetermined electric potential. The light exposing unit 113 scans a light beam to the photosensitive body 111 to form the electrostatic latent image. The developing unit 114 applies a developer, that is, a toner to the photosensitive body 111 on which the electrostatic latent image is formed to form a visible image.

A printable medium moves between the photosensitive body 111 and the transferring unit 115 by means of a feeding belt 180. At this time, the visible image formed on the photosensitive body 111 is transferred onto an opposite side of the printable medium.

The fusing unit 120 applies heat and pressure to the image transferred onto the printable medium to fuse the same. To this end, the fusing unit 120 includes a heating roller 122 which has a heating element (not shown) to generate heat, and a pressing roller 124 which contacts the heating roller 122 to form a fusing nip. The heating roller 122 and the pressing roller 124 rotate in engagement with each other under a predetermined pressure and apply heat and pressure to the image transferred on the printing medium to fuse the same. The heating element of the heating roller 122 may be provided as a halogen lamp, a heating wire, an induction heater or the like.

The power supply 130 supplies an AC power to the fusing unit 120. More specifically, the power supply 130 supplies the power to the heating roller 122 by a PWM (Pulse Width Modulation) method. The power supply 130 may include an HVPS (High Voltage Power Supply) to supply a high voltage power to the image forming unit 110.

The switching unit 140 switches the power supplied to the fusing unit 120 from the power supply 130. The switching unit 140 may be provided as a switching transistor (MOSFET) which turns ON/OFF to selectively supply the power to the fusing unit 120.

The controller 150 controls the switching unit 140 to prevent the power from being supplied to the fusing unit 120 in at least a section until initialization of the image forming apparatus 100 is completed. In other words, the controller 150 supplies the power to the fusing unit 120 in another section during the initialization.

Figure 4:
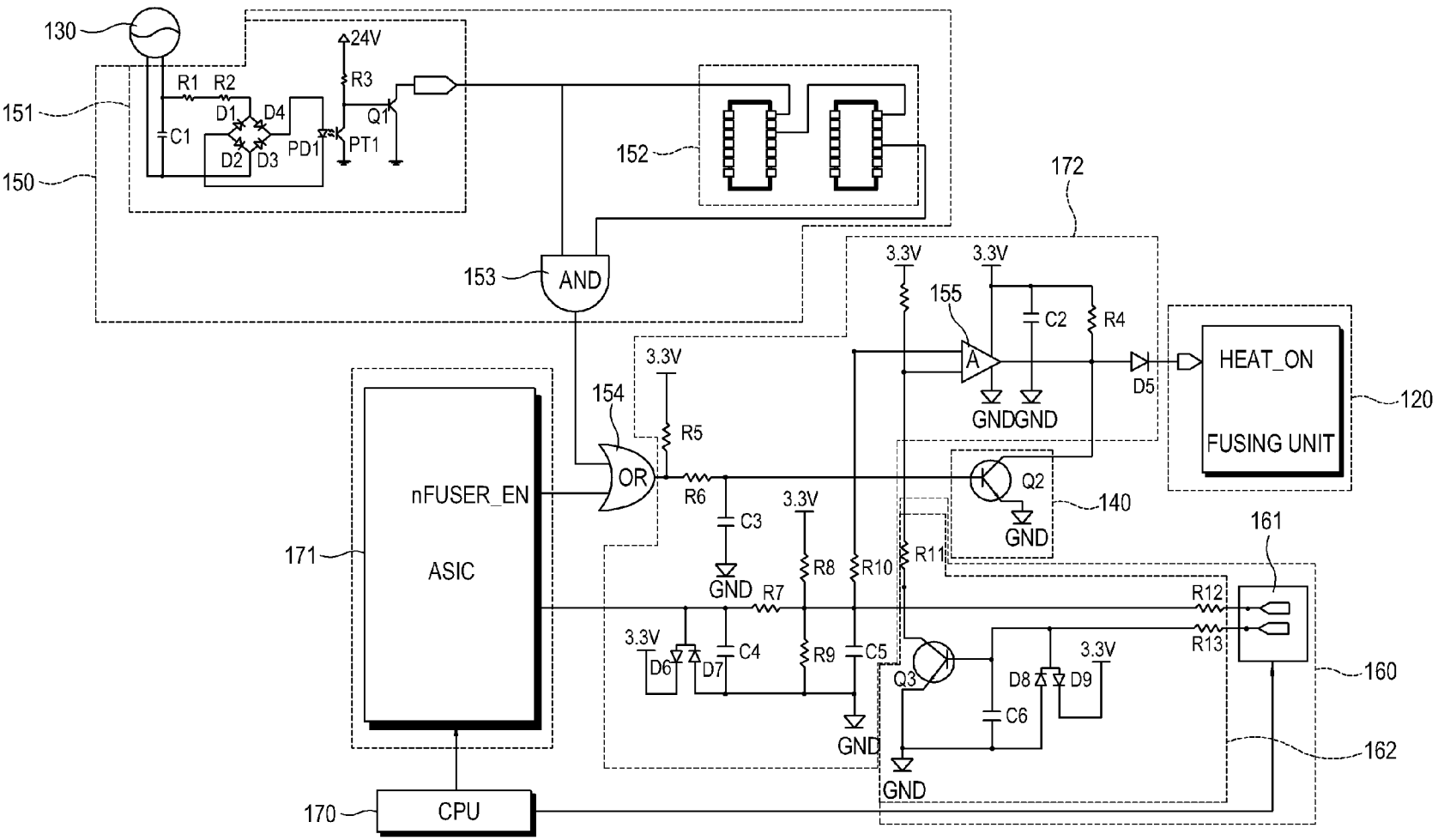
FIG. 4 is a circuit diagram for illustrating a controller in the image forming apparatus according to the exemplary embodiment of the present invention.

Here, as shown in FIG. 4, the controller 150 may include a zero-cross detection circuit 151 to detect the section when the power is not supplied. The zero-cross detection circuit 151 detects a point when the phase of the AC power supplied from the power supply 130 is changed and outputs a zero-cross signal.

The controller 150 may further include a counting circuit 152 arranged to count the time when the initialization of the image forming apparatus 100 is performed. The counting circuit 152 includes at least one counting device and counts the number of pulses of the zero-cross signal outputted from the zero-cross detection circuit 151. If the number of the pulses of the zero-cross signal reaches a predetermined value, the counting circuit 152 converts the level of a counting signal and outputs the counting signal. Here, the time when the counted pulses reach the predetermined value refers to the time when the initialization of the image forming apparatus 100 is performed, and to a standby time until a CPU 170 (to be described later) operates normally.

The controller 150 may further include an AND gate 153 which is provided at output sides of the zero-cross detection circuit 151 and the counting circuit 152.

Figure 3:
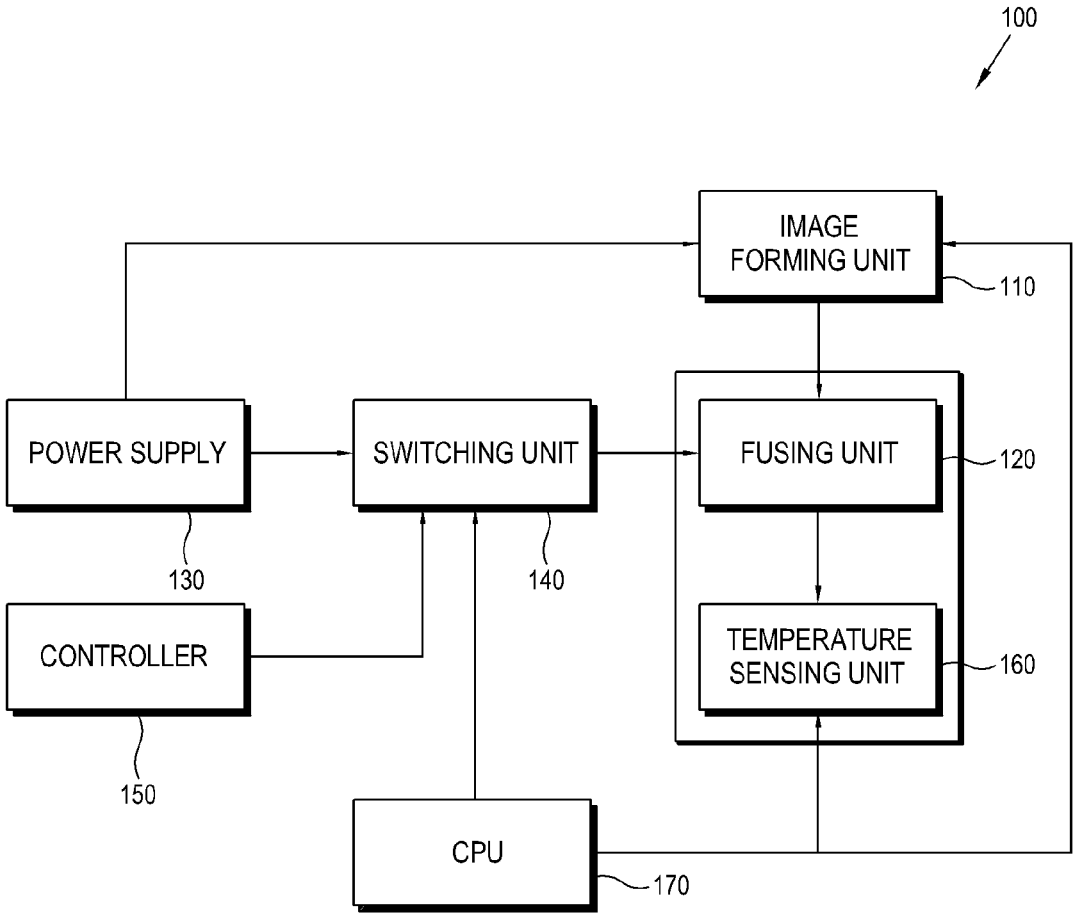
FIG. 3 illustrates an image forming apparatus according to another example embodiment of the present invention.

As shown in FIG. 3, the image forming apparatus 100 may further include a temperature sensing unit 160 and the CPU 170.

The temperature sensing unit 160 senses a temperature of outer circumferential surfaces of the heating roller 122 and the pressing roller 124 of the fusing unit 120, and may be provided as a thermistor which shows a relatively big resistance change with respect to a small temperature change.

The CPU 170 controls the power being supplied to the fusing unit 120 based on the temperature sensed by the temperature sensing unit 160 if the initialization of the image forming apparatus 100 is completed. More particularly, the CPU 170 cuts off the power being supplied to the fusing unit 120 from the power supply 130 if the sensed temperature is equal to or higher than a first predetermined value, and supplies again the power to the fusing unit 120 if the sensed temperature is equal to or lower than a second predetermined value, so as to maintain the temperature of the fusing unit 120 or the amount of heat radiated by the fusing unit 120 uniformly.

Here, the initialization time of the image forming apparatus 100 refers to the time until firmware of the CPU 170 is executed so that the CPU 170 normally controls the fusing unit 120 by means of the temperature sensing unit 160 after the power is supplied to the image forming apparatus 100. According to an example embodiment of the present embodiment, the initialization time is set as the counting time of the counting circuit 152 in consideration of a processing speed of the CPU 170.

Hereinafter, a control process of the fusing unit 120 according to an example embodiment of the present invention will be described with reference to FIGS. 4 and 5A-5I.

Figures 5A, 5B, 5C, 5D, 5E, 5F, 5G, 5H, 5I:
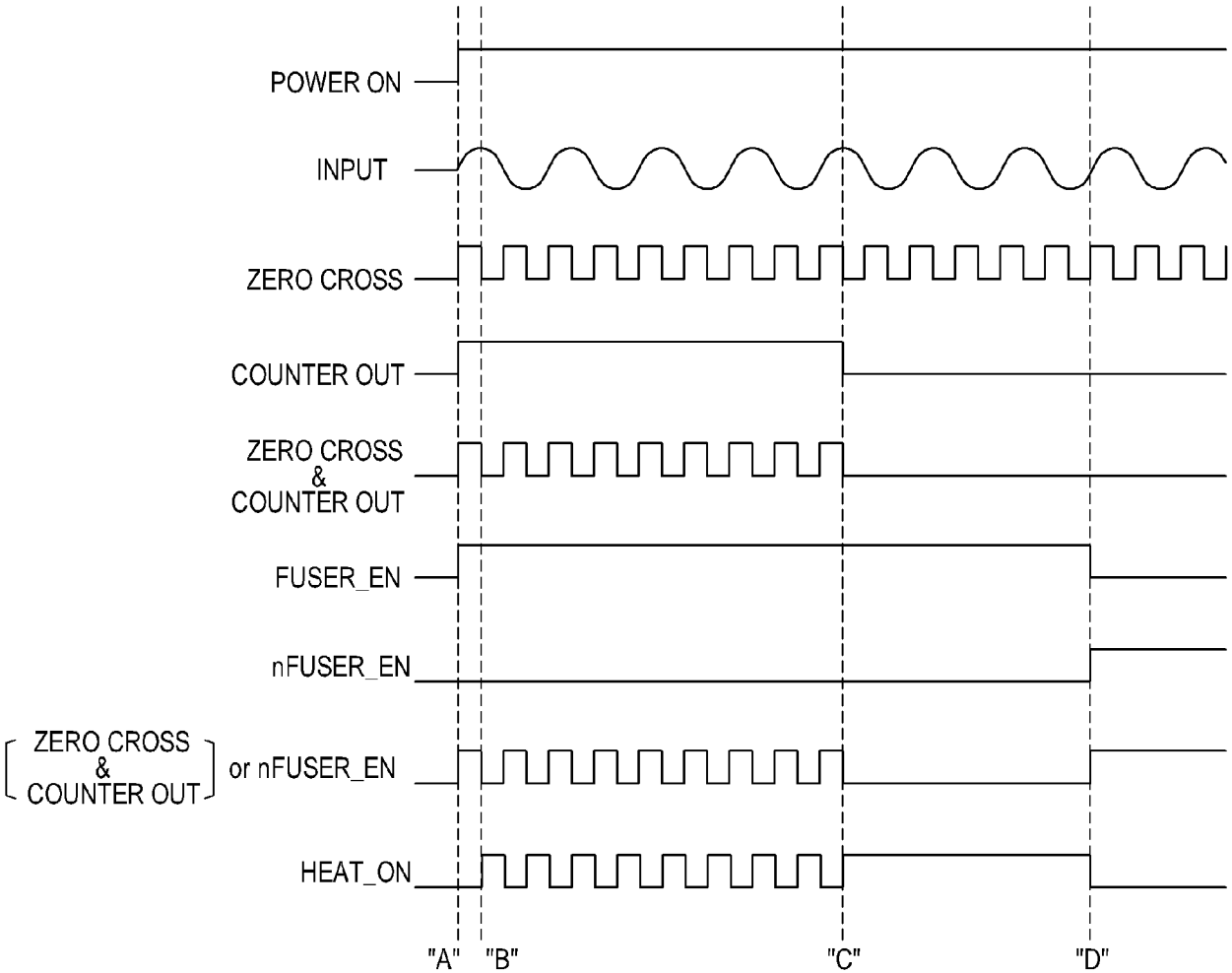
FIGS. 5A-5I illustrate waveforms of control signals in the image forming apparatus according to an example embodiment of the present invention.

If power is supplied to the image forming apparatus 100 at point "A" shown in FIG. 5A, an input AC power having a predetermined frequency, as shown in FIG. 5B is supplied to the zero-cross detection circuit 151 from the power supply 130, shown in FIG. 4. Then, the zero-cross detection circuit 151 outputs a zero-cross signal (ZERO CROSS) as shown in FIG. 5C. For example, if an input AC power of 50 Hz is supplied, a zero-cross signal (ZERO CROSS) having high and low levels repeating at a cycle of 20 msec is outputted.

As shown in FIG. 4, the zero-cross detection circuit 151 may include a capacitor C1, resistances R1, R2 and R3, diodes D1, D2, D3 and D4, a photo-coupler including a light emitter PD1 and a light receiver PT1, and a transistor Q1.

The counting circuit 152 which may include at least one counting device receives the zero-cross signal outputted from the zero-cross detection circuit 151 and counts the number of pulses thereof. The counting circuit 152 converts the level of a counting signal (COUNTER OUT) from high to low level, and outputs the COUNTER OUT signal, as shown in FIG. 5D, at point "C" when the number of the pulses reaches a predetermined value. For example, if the initialization time of the CPU 170 is 500 msec, the counting circuit 152 counts the number of pulses of the zero-cross signal, shown in FIG. 5C, generated at a cycle of 20 msec and converts the level of the counting signal (COUNTER OUT) from high to low if the number of the counted pulses reaches 25 and outputs the COUNTER OUT signal, shown in FIG. 5D.

Here, the reference values of the counting circuit 152 are preset depending on the type and the number of the counting device of the counting circuit 152 in consideration of the initialization time of the CPU 170.

The zero-cross signal (ZERO CROSS) outputted from the zero-cross detection circuit 151 and the counting signal (COUNTER OUT) outputted from the counting circuit 152 are inputted to the AND gate 153 shown in FIG. 4.

The AND gate 153 logically combines the zero-cross signal (ZERO CROSS) and the counting signal (COUNTER OUT) and outputs the result. As shown in FIG. 5E, the result, that is, an output signal (ZERO CROSS & COUNTER OUT) of the AND gate 153 repeats high and low levels like the zero-cross signal (ZERO CROSS) and maintains the low level after point "C" when the level of the counting signal (COUNTER OUT) becomes low.

An OR gate 154 logically combines the ZERO CROSS & COUNTER OUT signal, shown in FIG. 5E, and an nFUSER_EN, shown in FIG. 5G (to be described later) and outputs the result. As shown in FIG. 5G, since the level of the nFUSER_EN maintains low until point "C", that is, during the initialization of the image forming apparatus 100, an output signal (ZERO CROSS & COUNTER OUT or nFUSER_EN) of the OR gate 154 repeats high and low levels like the ZERO CROSS & COUNTER OUT.

A switching transistor Q2 receives the signal from the OR gate 154 and outputs a signal (HEAT_ON) to be supplied to the fusing unit 120. Here, the switching transistor Q2 may reverse the level of the signal from the OR gate 154 and output the same.

As shown in FIG. 5I, the HEAT_ON maintains a low level at point "A" when the power is initially supplied, becomes a high level at point "B" when the zero-cross signal is detected, and then, repeats the high and low levels until point"C". That is, the fusing unit 120 is in an OFF state at point "A" and changes into an ON state at point"B". Accordingly, the power is repeatedly supplied.

As described above, the image forming apparatus 100 according to the present invention does not supply power to the fusing unit 120 in at least a time section, to thereby prevent concentration of the power.

On the other hand, an ASIC 171 outputs the nFUSER_EN signal, shown in FIG. 5G, to the OR gate 154 under control of the CPU 170.

The CPU 170 applies a (FUSER_EN signal, shown in FIG. 5F, of a high level if power is supplied. Here, as shown in FIG. 5F, the applied FUSER_EN maintains the high level until point "C" when the initialization of the image forming apparatus 100 is completed since the CPU 170 does not control the temperature of the fusing unit 120 until point"C".

The ASIC 171 outputs the nFUSER_EN reversed from the FUSER_EN. That is, as shown in FIGS. 5F-5G, the nFUSER_EN maintains the low level until point"D", and accordingly, the output signal of the OR gate 154 is controlled by the operation results of the zero-cross detection circuit 151, the counting circuit 152 and the AND gate 153 during the initialization of the image forming apparatus 100.

The output signal of the counting circuit 152 (i.e., COUNTER OUT signal) changes into the low level after the initialization of the image forming apparatus 100, and accordingly, the power is supplied to the fusing unit 120 under control of the CPU 170.

The CPU 170 controls the ASIC 171 to change the nFUSER_EN signal from a low level to a high level and output the same, at point "D" if the temperature sensed by the temperature sensor 161 is equal to or higher than the first predetermined value. The nFUSER_EN signal is operated by the OR gate 154 and the switching transistor Q2 and is outputted as the HEAT_ON signal, shown in FIG. 5I changed from a high level to a low level. Accordingly, the power being supplied to the fusing unit 120 is cut off.

If the sensed temperature is equal to or lower than the second predetermined value, the controller 170 controls the ASIC 171 to change the nFUSER_EN into the low level and output the same. The nFUSER_EN signal is operated by the OR gate 154 and the switching transistor Q2 and is outputted as the HEAT_ON changed into the high level. Accordingly, the power is supplied again to the fusing unit 120.

For example, referring to FIG. 5G the nFUSER_EN becomes the high level if the temperature sensed at point "D" is equal to or higher than the first predetermined value, and is outputted as the HEAT_ON signal of the low level, shown in FIG. 5I. Accordingly, the power is not supplied to the fusing unit 120 after point "D".

The temperature sensor 161 continuously senses the temperature of the fusing unit 120 to which the power is not supplied. Then, if the sensed temperature is equal to or lower than the second predetermined value, the nFUSER_EN becomes the low level and is outputted as the HEAT_ON signal of the high level. Accordingly, the power is supplied again to the fusing unit 120.

As described above, after the initialization of the image forming apparatus 100, the fusing unit 120 may maintain the temperature or the heat amount thereof uniformly under the control of the CPU 170.

The image forming apparatus 100 may further include a temperature sensor protection circuit 162 which includes a transistor Q3, diodes D8 and D9, a capacitor C6 and a resistance R11, R12 and R13, so as to protect the fusing unit 120 in the case that the temperature sensor 161 malfunctions.

The temperature sensor protection circuit 162 opens the transistor Q3 to cut off the power being supplied to the fusing unit 120 if the temperature of the fusing unit 120 abnormally and continuously rises based on an electric potential level of the temperature sensor 161.

The image forming apparatus 100 may further include a controller protection circuit 172 which includes diodes D5, D6 and D7, capacitors C2 through C5, resistances R4 through R10 and a comparator 155, so as to prevent a malfunction of the apparatus.

Figure 6:
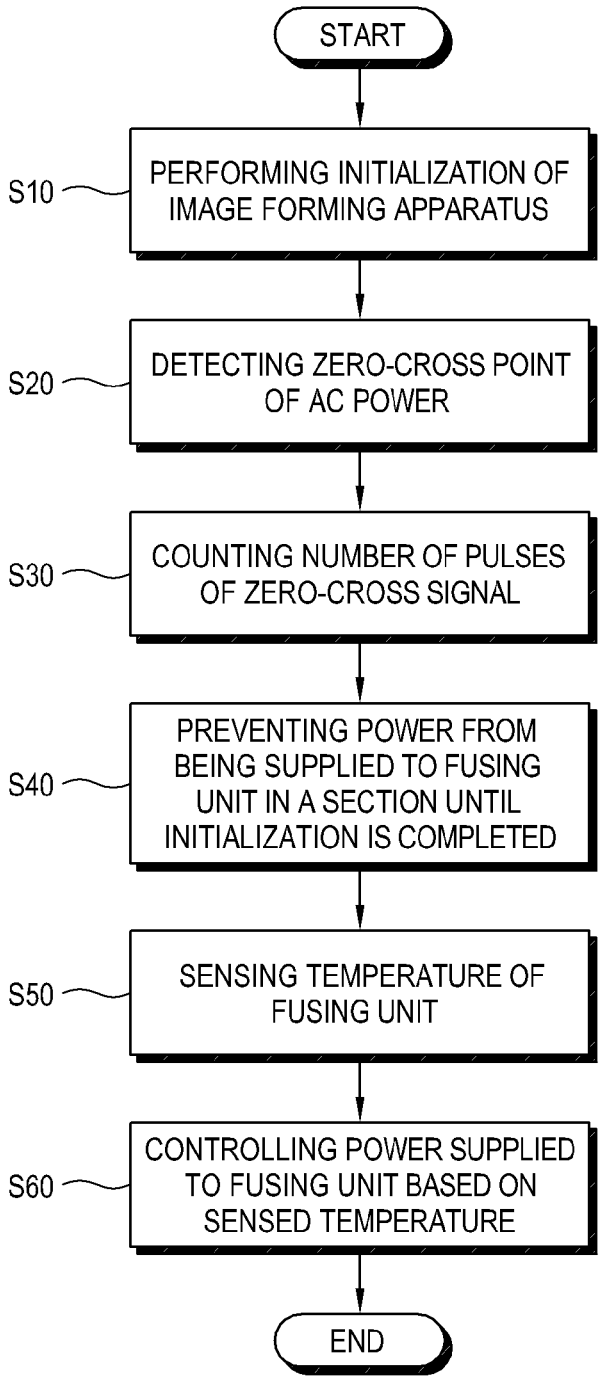
FIG. 6 is a flow chart for illustrating a control method of the image forming apparatus according to an example embodiment of the present invention.

Hereinafter, a control method of the image forming apparatus according to an example embodiment of the present invention will be described with reference to FIG. 6.

First, the image forming apparatus 100 performs initialization to the CPU 170 as power is supplied thereto at block S10.

Then, the zero-cross detection circuit 151 detects a zero-cross point of an AC power supplied from the power supply 130 and outputs a zero-cross signal at block S20.

Next, the counting circuit 152 counts the number of pulses of the zero-cross signal outputted from the zero-cross detection circuit 151 at block S30. Here, the counting circuit 152 changes the level of a counting signal (COUNTER OUT) and outputs the counting signal (COUNTER OUT) having a low level if the number of the pulses reaches a predetermined value. The time until the number of the pulses of the zero-cross signal reaches a predetermined value refers to a standby time until the initialization of the image forming apparatus 100, that is, the CPU 170 is completed for a normal operation.

Next, the controller 150 controls to supply the power to the fusing unit 120 in a section until the initialization of the CPU 170 is completed at block S40. Here, the controller 150 is provided to include the AND gate 153 which logically combines the zero-cross signal and the counting signal (COUNTER OUT) and outputs the result, and which controls to cut off the power being supplied to the fusing unit 120 at the zero-cross point of the AC power detected by the zero-cross detection circuit 151.

If the initialization of the image forming apparatus 100 is completed, the CPU 170 senses the temperature of the fusing unit 120 by means of the temperature sensing unit 160 at block S50.

Then, the CPU 170 controls the power being supplied to the fusing unit 120 based on the sensed temperature to maintain the temperature or the heat amount of the fusing unit 120 uniformly at block S60.

As described above, according to the present invention, there is provided an image forming apparatus which can control power being supplied to a fusing unit during initialization of the image forming apparatus so as to prevent the power from being concentrated on the fusing unit, and a control method thereof.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various example embodiments disclosed, but that the present invention includes all embodiments falling within the scope of the appended claims.

What is claimed is:

1. An image forming apparatus comprising:

a fusing unit which fuses an image transferred to a printable medium;

a power supply which supplies power to the fusing unit;

a central processing unit (CPU) which controls the power supplied to the fusing unit;

a switching unit which switches the power supplied to the fusing unit; and a controller which controls the switching unit to prevent the power from being supplied to the fusing unit in at least a time section during initialization of the image forming apparatus, wherein the time section during initialization of the image forming apparatus is a time until a firmware of the CPU is executed.

2. The image forming apparatus according to claim 1, wherein the controller comprises a zero-cross detection circuit which detects a zero-cross point of the power supplied from the power supply.

3. The image forming apparatus according to claim 2, wherein the controller cuts off the power being supplied to the fusing unit at the zero-cross point.

4. The image forming apparatus according to claim 2, further comprising a counting circuit which counts the number of pulses of a zero-cross signal which is outputted from the zero-cross detection circuit during the initialization of the image forming apparatus.

5. The image forming apparatus according to claim 4, further comprising an AND gate provided to logically combine outputs of the zero-cross detection circuit and the counting circuit.

6. The image forming apparatus according to claim 1, further comprising a temperature sensing unit which senses a temperature of the fusing unit, wherein the CPU controls the power supplied to the fusing unit on the basis of the temperature sensed by the temperature sensing unit if the initialization of the image forming apparatus is completed.

7. A method of controlling an image forming apparatus comprising a fusing unit which fuses an image transferred to a printable medium, a power supply which supplies power to the fusing unit and a central processing unit (CPU) which controls the power supplied to the fusing unit, the method comprising:

performing initialization to the image forming apparatus; and preventing supplying the power to the fusing unit in at least a time section during the initialization of the image forming apparatus, wherein the time section during initialization of the image forming apparatus is a time until a firmware of the CPU is executed.

8. The method according to claim 7, further comprising detecting a zero-cross point of the power supplied from the power supply while the power is being supplied to the fusing unit.

9. The method according to claim 8, wherein the power is not supplied to the fusing unit at the zero-cross point during the supplying of the power to the fusing unit.

10. The method according to claim 8, further comprising counting the number of pulses of a zero-cross signal which is outputted at the zero-cross point during the supplying of the power to the fusing unit.

11. The method according to claim 7, further comprising:

sensing a temperature of the fusing unit; and controlling the power which is supplied to the fusing unit according to the sensed temperature if the initialization of the image forming apparatus is completed.

12. An image forming apparatus comprising:

an image forming unit to transfer an image onto a printable medium in response to print data;

a fusing unit arranged to fuse the image transferred onto the printable medium;

a central processing unit (CPU) arranged to control the power supplied to the fusing unit; and a controller arranged to control operation of the image forming unit and the fusing unit, including performing initialization of the image forming apparatus when an AC power is supplied thereto, and preventing the power from being supplied to the fusing unit in at least a time section during initialization of the image forming apparatus, wherein the time section during initialization of the image forming apparatus is a time until a firmware of the CPU is executed.

13. The image forming apparatus according to claim 12, wherein the controller comprises:

a zero-cross detection circuit arranged to detect a zero-cross point of the AC power supplied from a power source and to generate a zero-cross signal;

a counting circuit arranged to count a number of pulses of the zero-cross signal and to generate a counter signal when the number of pulses of the zero-cross signal reaches a predetermined value; and an AND gate arranged to logically combine the zero-cross signal and the counter signal and to produce a signal indicating completion of the initialization;

wherein the CPU controls the power supplied to the fusing unit on the basis of a temperature of the fusing unit and the signal indicating completion of the initialization, such that the power is prevented from being supplied to the fusing unit in at least the time section during initialization of the image forming apparatus.

14. The image forming apparatus according to claim 12, further comprising a temperature sensing unit arranged to sense a temperature of the fusing unit, wherein the CPU controls the power supplied to the fusing unit on the basis of the temperature of the fusing unit when the initialization of the image forming apparatus is completed.

15. The image forming apparatus according to claim 14, further comprising a protection circuit arranged to cut off the power supplied to the fusing unit when the temperature of the fusing unit is abnormal.

* * * * *

UNITED STATES PATENT AND TRADEMARK OFFICE

CERTIFICATE OF CORRECTION

PATENT NO. : 7,965,956 B2
APPLICATION NO. : 12/164220
DATED : June 21, 2011
INVENTOR(S) : Nyun-Kang Lee et al.

It is certified that error appears in the above-identified patent and that said Letters Patent is hereby corrected as shown below:

Column 10, Line 12, In Claim 13, delete "initialization;" and insert -- initialization, --, therefor.

Signed and Sealed this
Fourteenth Day of February, 2012

David J. Kappos

David J. Kappos
*Director of the United States Patent and Trademark Office*